United States Patent [19]

Garat

[11] Patent Number: 5,014,764

[45] Date of Patent: May 14, 1991

[54] LOST-FOAM CASTING, OF ALUMINUM UNDER PRESSURE

[75] Inventor: Michel Garat, Voiron, France

[73] Assignee: Aluminium Pechiney, Paris, France

[21] Appl. No.: 437,103

[22] Filed: Nov. 16, 1989

Related U.S. Application Data

[63] Continuation-in-part of Ser. No. 334,530, Apr. 7, 1989, abandoned, which is a continuation-in-part of Ser. No. 116,213, Nov. 3, 1987, abandoned.

[30] Foreign Application Priority Data

Nov. 17, 1986 [FR] France ..... 86 16415
Sep. 7, 1989 [FR] France ..... 89 11943

[51] Int. Cl.[5] ..... B22C 9/04; B22D 27/13; B22D 21/04

[52] U.S. Cl. ..... 164/34; 164/120

[58] Field of Search ..... 164/34, 35, 66.1, 76.1, 164/120

[56] References Cited

U.S. PATENT DOCUMENTS 3,420,291 1/1969 Chandley et al. ..... 164/66.1
4,709,461 12/1987 Freeman, Jr. ..... 164/122 X

FOREIGN PATENT DOCUMENTS 2606688 5/1988 France ..... 164/34
43-7526 3/1968 Japan ..... 164/34
55-144375 11/1980 Japan ..... 164/66.1

*Primary Examiner*—J. Reed Batten, Jr.
*Attorney, Agent, or Firm*—Denison, Meserole, Pollack & Scheiner

[57] ABSTRACT

An organic foam pattern of the article to be cast is immersed in a dry sand mold containing no binder, the mold is filled with molten aluminum or aluminum alloy which replaces the foam and gradually solidifies, and an increasing isostatic gas pressure is simultaneously applied to the mold and to the aluminum or aluminum alloy after filling of the mold is complete. The isostatic gas pressure rises to a maximum value higher than 1.5 MPa and up to 10 MPa, and results in cast articles having improved mechanical characteristics and, in particular, better resistance to fatigue.

4 Claims, 1 Drawing Sheet

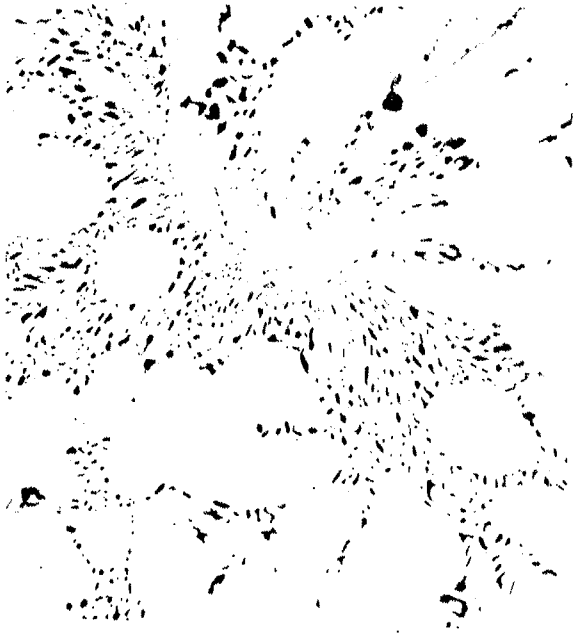

LOST-FOAM CASTING, OF ALUMINUM UNDER PRESSURE

This application is a continuation-in-part of Ser. No. 334,530, filed Apr. 7, 1989, which is a continuation-in-part of Ser. No. 116,213, filed Nov. 3, 1987, both now abandoned.

The present invention relates to a process for the lost-foam casting, under pressure, of metal articles, in particular of aluminum and alloys thereof.

It is known to a person skilled in the art, mainly from the teaching of U.S. Pat. No. 3,157,924, that patterns of polystyrene foam which are immersed in a mold formed from dry sand containing no binder can be used for casting. In such a process, the metal to be cast, which has previously been melted, is brought into contact with the pattern by means of channels traversing the sand and is gradually substituted for said pattern by burning it and transforming it into vapour which escapes between the grains of sand.

This method has proven to be attractive on an industrial scale because it avoids the preliminary manufacture, by compacting and agglomeration of powdered refractory materials, of rigid molds connected in a fairly complicated manner via channels to cores, and allows simply recovery of the castings and easy recycling of the casting materials. However this method is handicapped by two factors:

- the relative slowness of solidification which promotes the formation of gassing pin-holes
- the relative weakness of the thermal gradients which can cause micro-shrinkage if the outline of the part complicates feeding thereof.

With aim of overcoming such drawbacks, a lost-foam casting process has been developed which forms subject of the patent application published in France under No. 2606 688 and which corresponds to U.S. application Ser. No. 116,213, filed Nov. 3, 1987, now abandoned.

This application teaches that, after having filled the mold with the molten metal, that is to say when the pattern has been destroyed completely by the metal and the vapour given off by the foam has been evacuated, an isostatic gas pressure is exerted on the assembly of mold and metal, preferably before the metal begins solidifying. This pressure is applied with values which increase over time so as to avoid the phenomenon of metal penetration and so that the maximum value is attained in less than 15 seconds.

Under these conditions, the castings obtained have increased density which is manifested by an improvement in the mechanical characteristics, in particular with regard to the strength.

However, it is disclosed in this application that it was preferable to employ a maximum pressure of between 0.5 and 1.5 MPa and that it was unnecessary to exceed the latter limit.

In fact, it was noted after more advanced research that if the pressure were further increased, not only the mechanical characteristics such as the breaking strength Rm, the yield stress LE and the elongation A but also the resistance to fatigue F were improved.

Hence the present invention, which involves a process for the lost-foam casting, under pressure, of metal articles, in particular of aluminum and alloys thereof, in which an organic foam pattern of the article to be cast is immersed into a mold, the walls of which are defined by a bath of dry sand containing no binder, the mold is filled with the molten metal which is substituted for the foam and gradually solidifies, and an increasing isostatic gas pressure is applied simultaneously to the mold, and to the metal at the earliest on completion of filling, characterised in that the pressure exerted rises to a value of between 1.5 and 10 MPa.

Therefore, the invention involves employing pressures of between 1.5 and 10 MPa and preferably between 5 and 10 MPa.

As in French patent application No. 2 606 688, the pressure can be exerted by means of a sealed box in which the mold is placed, said box being equipped with one or more nozzles conveniently distributed over its wall and connected to a source of gas under pressure.

In the selected pressure range, it has been found that the phenomena produced during the application of pressure were quite different from those according to the prior art.

In fact, between 0.5 and 1.5 MPa, the pressure serves mainly to accelerate the flow of molten metal between the dendrites of the solidifying metal and the effect stops when the solid network has reached a certain stage of development. In particular, this is how the low pressures enable the feeder effectively to prevent the phenomenon of shrinkage marks due to the contraction of the solidfying metal.

On the other hand, the flowing effect of the molten metal, which is preponderant at the beginning of solidification, is gradually replaced by an effect of hot deformation of the already solidified metal network, under pressures higher than 1.5 MPa and, in particular, higher than 5 MPa, this phenomenon becoming dominant and then exclusive when the solidification rate reaches values of about 50 to 70%, depending on the type of alloy cast. The application of high pressures therefore produces a type of isostatic forging which affects the entire surface of the casting.

The accompanying FIG. 1 is a micrograph of an A-S7G03 alloy cast according to the invention under a pressure of 7 MPa then heat treated. This micrograph shows the plastic deformation imposed on the dendritic network which has the effect of filling up the pores, and illustrates well the forging effect to which the metal is subjected in this process.

Under these conditions, it is found that the mechanical characteristics of the articles are significantly improved and, in particular, the resistance to fatigue. Pressures higher than 10 MPa only produce insignificant improvements.

This new pressure range is preferably applied before the quantity of solidified metal reaches 40% by weight so that the liquid flow can be acted upon.

It is also preferable for the maximum pressure applied to be attained before the quantity of solidified metal exceeds 90% so as to benefit fully from the effect of deformation.

As in French patent application No. 2 606 688, it is preferable for the pressure to be applied by a gradual increase, in particular at the beginning of solidification, to prevent "metal penetration", a phenomenon resulting from a transitory imbalance between the pressure exerted directly on the metal and the pressure exerted on the metal by means of the sand bath. In fact, the bath causes a relatively great loss of charge in the transmission of pressure resulting, in the region of the metal which is in contact with the sand, in a tendency for this pressure to push the metal through the grains of sand and to deform the casting.

The invention can be illustrated by the following embodiment: hollow cylindrical bodies having an external diameter of 45 mm and a wall thickness of 4 mm and comprising adjacent ribs and bosses of 20×20×80 mm were cast by the earlier process and by the process according to the invention, that is to say an isostatic gas pressure corresponding to atmospheric pressure, to 1 MPa, to 5 MPa and to 10 MPa respectively was applied to the interior of the chamber containing the mold just before the beginning of solidification.

These bodies were produced from two types of alloys having high mechanical characteristics:

A-S7G03 having a composition in per cent by weight of Fe 0.20; Si 6.5-7.5; Cu 0.10; Zn 0.10; Mg 0.25-0.40; Mn 0.10; Ni 0.05; Pb 0.05; Sn 0.05; Ti 0.05-0.20; remainder Al;

A-U5GT having a composition: Fe 0.35; Si 0.20; Cu 4.20-5.00; Zn 0.10; Mg 0.15-0.35; Mn 0.10; Ni 0.05; Pb 0.05; Sn 0.05; Ti 0.05-0.30; remainder Al.

The mechanical tests carried out on said bodies after standard Y23 heat treatments in the case of A-S7G03 and Y24 heat treatments in the case of A-U5GT enabled the following characteristics to be measured as a function of the pressures applied:

In the A-S7G03, the quality index Q in MPa which corresponds to the formula $Q=R+150 \log A$, wherein R is the strength in MPa and A is the elongation in % on both the thick and thin regions of the articles.

In A-U5GT, the yield stresses LE in MPa, the strength R in MPa and the elongation A in %, also in both the thick and thin regions.

Furthermore, the resistance to fatigue F was measured in MPa for each of the alloys and each of the pressures applied from torsion tests on a sample machined at $10^7$ cycles by the staircase method. F applies both to the thick and thin regions because it does not depend on the rate of solidification but on the porosity and consequently on the pressure applied.

The results are given in the following table.

TABLE

| | A-S7GO3 | | | A-U5Gt | | | | | | |
|---|---|---|---|---|---|---|---|---|---|---|
| | Thick region | Thin region | | Thick region | | | Thin region | | | |
| | Q | Q | F | LE | R | A | LE | R | A | F |
| Solidification under atmospheric P | 240 | 325 | 40 | 235 | 340 | 8 | 260 | 355 | 7 | 90 |
| Solidification under 1 MPa | 335 | 420 | 65 | 240 | 365 | 8 | 260 | 405 | 11 | 120 |
| Solidification under 5 MPa | 410 | 460 | 85 | 250 | 400 | 12 | 260 | 410 | 15 | 130 |
| Solidification under 10 MPa | 440 | 490 | 100 | 260 | 420 | 15 | 260 | 420 | 18 | 140 |

An improvement in all the characteristics measured and, in particular, increased resistance to fatigue are observed.

What is claimed is:

1. In a process for lost foam casting of aluminum and aluminum alloys comprising immersing an organic foam pattern of an article to be cast into a dry sand mold containing no binder, filling the mold with molten aluminum or aluminum alloy which replaces the foam pattern and gradually solidifies, and applying, at the earliest on completion of filling, an increasing isostatic gas pressure simultaneously to the mold and aluminum alloy, the improvement wherein said isostatic gas pressure rises to a maximum value higher than 1.5 MPa and up to 10 MPa.

2. A process according to claim 1, wherein the pressure applied rises to a maximum value of between 5 and 10 MPa.

3. A process according to claim 1, wherein the pressure is applied at the latest when the quantity of solidified aluminum or aluminum alloy reaches 40% by weight.

4. A process according to claim 1, wherein the maximum value is attained before the quantity of solidified aluminum or aluminum alloy exceeds 90% by weight.

* * * * *